US006280085B1

(12) United States Patent
Beer

(10) Patent No.: US 6,280,085 B1
(45) Date of Patent: Aug. 28, 2001

(54) FLEXIBLE PACKAGE WITH PEEL-AWAY COVERING

(75) Inventor: Jeffrey Scott Beer, Perkiomenville, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 09/532,183

(22) Filed: Mar. 20, 2000

(51) Int. Cl.[7] ..... B65D 33/00

(52) U.S. Cl. ..... 383/210; 383/111; 383/210; 206/484

(58) Field of Search ..... 383/111, 210, 383/211; 206/484, 484.2

(56) References Cited

U.S. PATENT DOCUMENTS

| | | | | |
|---|---|---|---|---|
| 892,074 | * | 6/1908 | Obici . | |
| 2,484,749 | * | 10/1949 | Salfisberg | 206/484 |
| 2,589,735 | * | 3/1952 | Salfisberg | 206/484 |
| 2,998,880 | * | 9/1961 | Ladd | 383/211 X |
| 3,189,174 | * | 6/1965 | Cormack | 383/111 X |
| 3,217,871 | * | 11/1965 | Lee | 383/211 X |
| 3,301,392 | * | 1/1967 | Regan, Jr. | 206/484 X |
| 3,326,450 | * | 6/1967 | Langdon | 383/211 X |
| 3,460,742 | * | 8/1969 | Langdon | 383/211 X |
| 3,785,930 | * | 1/1974 | Ellis | 206/484 X |
| 3,938,659 | * | 2/1976 | Wardell | 383/211 X |
| 4,055,672 | * | 10/1977 | Hirsch et al. | 206/484 X |
| 4,637,063 | * | 1/1987 | Sullivan et al. | 383/111 X |
| 4,681,228 | * | 7/1987 | Kerry et al. | 206/484 |
| 5,149,315 | | 9/1992 | Muhs . | |
| 5,281,027 | * | 1/1994 | Thrall | 383/111 X |
| 5,330,269 | * | 7/1994 | Kamada et al. | 383/210 |
| 5,538,345 | * | 7/1996 | Gotch et al. | 383/210 |
| 5,553,943 | * | 9/1996 | Cook et al. | 383/111 X |
| 5,691,015 | * | 11/1997 | Tsukamoto et al. | 206/484.2 X |
| 5,804,265 | * | 9/1998 | Saad et al. | 206/484 X |
| 5,947,288 | * | 9/1999 | Dykstra et al. | 206/484.2 X |
| 6,059,112 | * | 5/2000 | Dykstra et al. | 206/484.2 X |
| 6,066,404 | * | 5/2000 | Suzuura et al. | 206/484 X |
| 6,170,653 | * | 1/2001 | Panzer | 206/484 X |

FOREIGN PATENT DOCUMENTS

| | | | | |
|---|---|---|---|---|
| 515014 | * | 11/1939 | (GB) | 206/484 |
| 1503913 | * | 3/1978 | (GB) | 206/484 |

* cited by examiner

*Primary Examiner*—Allan N. Shoap
*Assistant Examiner*—Robin A. Hylton
(74) *Attorney, Agent, or Firm*—Caesar, Rivise, Bernstein, Cohen & Pokotilow, Ltd.

(57) ABSTRACT

A convertible package having an interior for holding a flowable product, e.g., a powder or granular material. The package includes at a front panel, a rear panel, and a removable covering. The front and rear panels are formed of a flexible sheets having a peripheral edge along which the panels are heat sealed to form the package's hollow interior. The removable cover is made up of a front cover sheet and a rear cover sheet, which are formed of a flexible material and are of a sufficient extent to encompass the entire area of the front panel and rear panels, respectively. The cover sheets are releasably secured along their periphery to respective ones of the packages front and rear panels to effectively isolate those panels from the ambient surroundings. The two cover sheets are arranged to be peeled off the panels, leaving the front and rear panels secured together with the product sealed within the hollow interior of the package.

5 Claims, 3 Drawing Sheets

FIG. 1
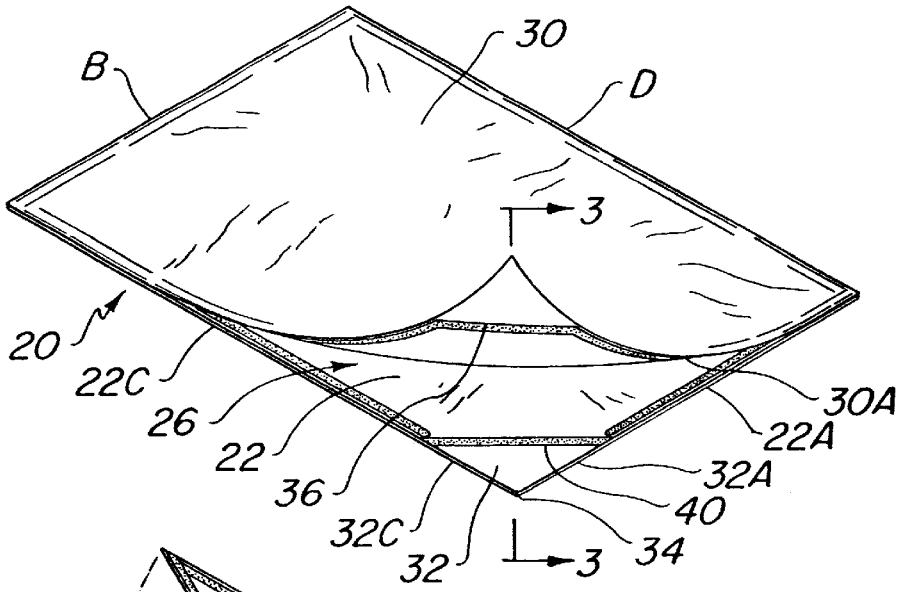
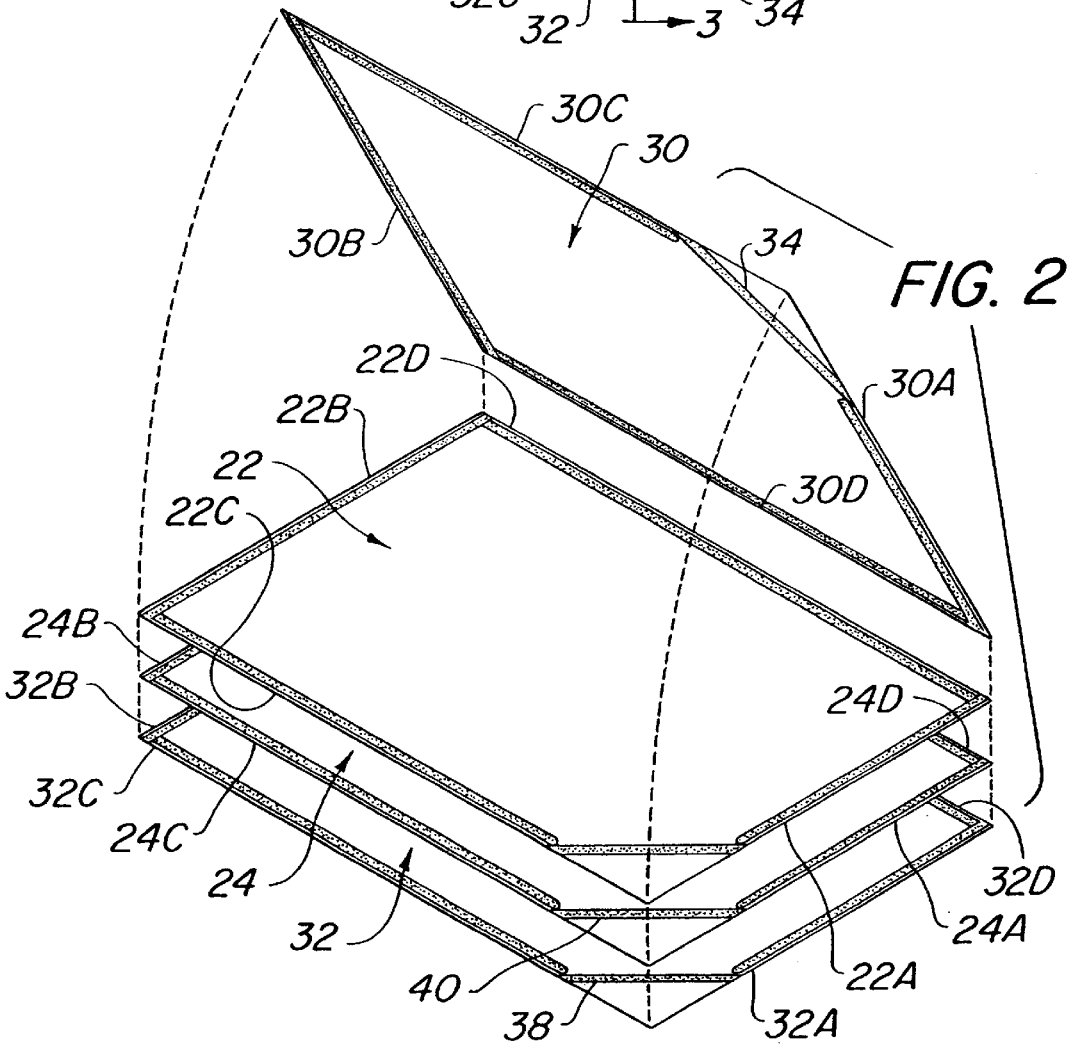
FIG. 2

FIG. 3
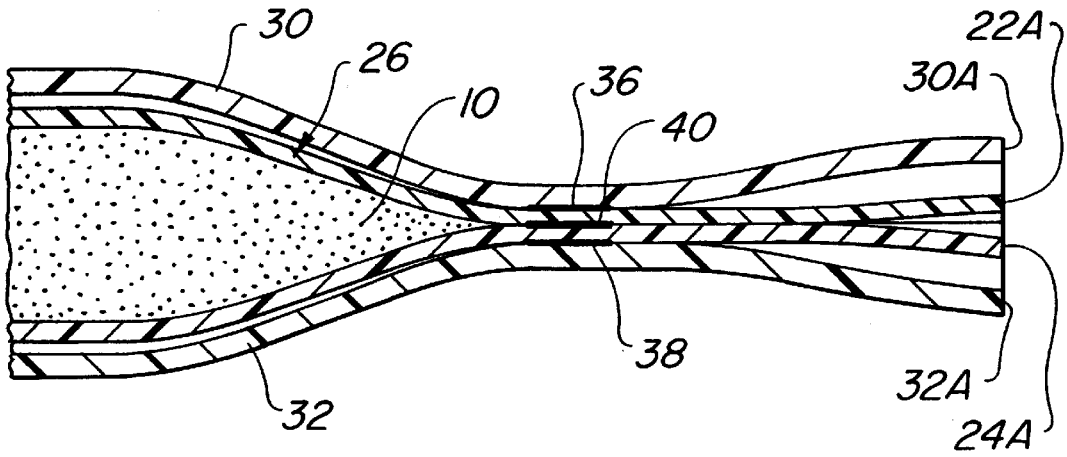
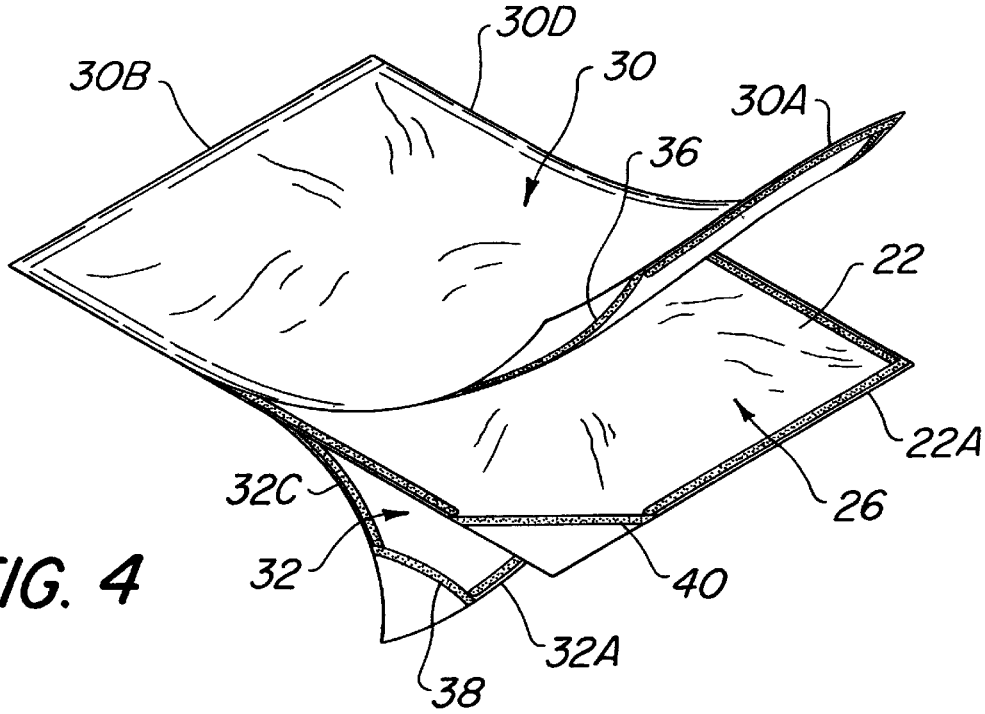
FIG. 4

FLEXIBLE PACKAGE WITH PEEL-AWAY COVERING

BACKGROUND OF THE INVENTION

This invention relates generally to flexible packages, and more particularly to flexible packages for holding flowable products suitable for use in clean environments.

Various types of flexible packages for holding particulate materials, e.g., foodstuffs, chemicals, etc., under vacuum have been disclosed in the patent literature and are commercially available today. One type of flexible package is commonly constructed in the form of a "bag," or "pouch," or "sack" having a front panel and a rear panel secured together along their marginal edges so that when it is filled it has the shape of a somewhat flattened pillow. In order to gain access to the product within the pouch, a mouth is typically provided adjacent the top end of the pouch. The mouth may be constructed so that the front and rear panels forming the pouch are releasably connected to each other, e.g., can be peeled apart, to enable the panels of the pouch to be grasped to open the mouth of the package. Alternatively, the mouth of the package can be made severable, e.g., it may be arranged such that it can be cut or torn along a predetermined line to provide access to the interior of the package.

For some industrial or food processing applications, flowable materials, e.g., powders, granular materials, etc., that need to be processed in a clean or sanitary environment to produce a final product are temporarily packaged to keep them clean or sanitary until they are ready for processing. Conventional containers, such as flexible packages, have left much to be desired for such temporary packaging applications, since such packages are susceptible to becoming soiled or otherwise contaminated during transportation and/or handling. Thus, flowable materials which are packaged in conventional flexible packages, typically will have to be taken out of the packages in which they were shipped/handled and placed in secondary (clean) packages or containers before being introduced into the clean environment for processing. Obviously, such action is wasteful of time and resources.

So called "two stage" packages have been provided in the prior art. Such packages make use of an inner wrapper in which the product to be processed is packaged. The inner wrapper is then placed in a second wrapper for shipping and handling to keep the innerwrapper's surface clean or otherwise uncontaminated during such shipping/handling. One example of such a prior art two stage package is shown in U.S. Pat. No. 5,149,315 (Muhs). That patent discloses a bag construction comprising an outer bag and an inner bag contained therein and a method of making the structure. The bag has an independent unitary construction and is made from a tube length having inner and outer portions, by cross sealing the inner portion and folding the outer portion into a rectangularly shaped bottom. The bottom of the bag is sealed to resist leakage so that the contents of the bag will be maintained in good condition without loss or deterioration by reason of sifting or breathing through breaks or openings in the bottom seal. The inner bag is leakproof and is adhered to the outer bag in a manner such that the inner bag can be removed easily from the outer bag for disposal purposes.

While the aforementioned prior art is generally suitable for its intended purposes, a need still presently exists for a flexible package for holding flowable materials that is to be kept sanitary and/or uncontaminated even when the package is handled and/or transported under conditions that would tend to soil or contaminate the exterior of the package, yet which can be converted into a clean state, suitable for introduction into a clean environment where the material within the package can be safely removed.

Accordingly, a need presently exists for a flexible package for holding flowable materials that is to be kept sanitary and/or uncontaminated even when the package is handled and/or transported under conditions that would tend to soil or contaminate the exterior of the package, yet which can be converted into a clean state, suitable for introduction into a clean environment where the material within the package can be safely removed.

OBJECTS OF THE INVENTION

Accordingly, it is a general object of this invention to provide a flexible package which addresses that need.

It is a further object of this invention to provide a convertible flexible package which is simple in construction.

It is a further object of this invention to provide a convertible flexible package which is easy to use.

It is a further object of this invention to provide a convertible flexible package for flowable materials that includes a removable outer covering which is arranged to be left in position for transportation and/or handling of the package and then removed when the package is about to be taken into a clean environment.

SUMMARY OF THE INVENTION

A package having an interior for holding a flowable product, e.g., a powder or granular material, therein. The package includes at a front panel, a rear panel, and a removable covering for those panels. The front and rear panels are formed of a flexible sheet material and each has a peripheral edge. The peripheral edges of the front and rear panels are secured, e.g., permanently heat sealed, to each other to form the hollow interior for the package for holding the product therein.

The removable cover comprises a front cover sheet and a rear cover sheet. The front cover sheet is formed of a flexible material and is of a sufficient extent to encompass the entire area of the front panel. The front cover sheet is releasably secured, e.g., peelably connected along its periphery, to the front panel to effectively isolate the front panel from the ambient surroundings. The rear cover sheet is also formed of a flexible material and is of a sufficient extent to encompass the entire area of the rear panel. The rear cover sheet is releasably secured, e.g., peelably connected along its periphery, to the rear panel to effectively isolate the rear panel from the ambient surroundings. Each of the cover sheets is arranged to be readily removed from, e.g., individually peeled off, the associated panels, leaving the front and rear panels secured together with the product sealed within the hollow interior of the package.

In accordance with one preferred aspect of this invention the package includes at least one corner. The front cover sheet is not secured to the front panel at the corner in order to enable a user of the package to grasp the front cover sheet at the corner to readily remove it, e.g., peel it, from the front panel. The rear cover sheet is also not secured to the front panel at the corner to enable the user to grasp the rear cover sheet to remove it from the rear panel.

DESCRIPTION OF THE DRAWING

FIG. 1 is an isometric view of a package, e.g., a pouch, constructed in accordance with this invention, with portions of its covering being shown in the process of being peeled off of the package;

FIG. 2 is an enlarged exploded isometric view of the package of FIG. 1;

FIG. 3 is an enlarged sectional view taken through one corner of the package of FIG. 1;

FIG. 4 is a view similar to FIG. 1, but showing the cover at a later stage in its removal from the package.

DETAILED DESCRIPTION OF THE PREFERRED EMBODIMENT

Figure 5:
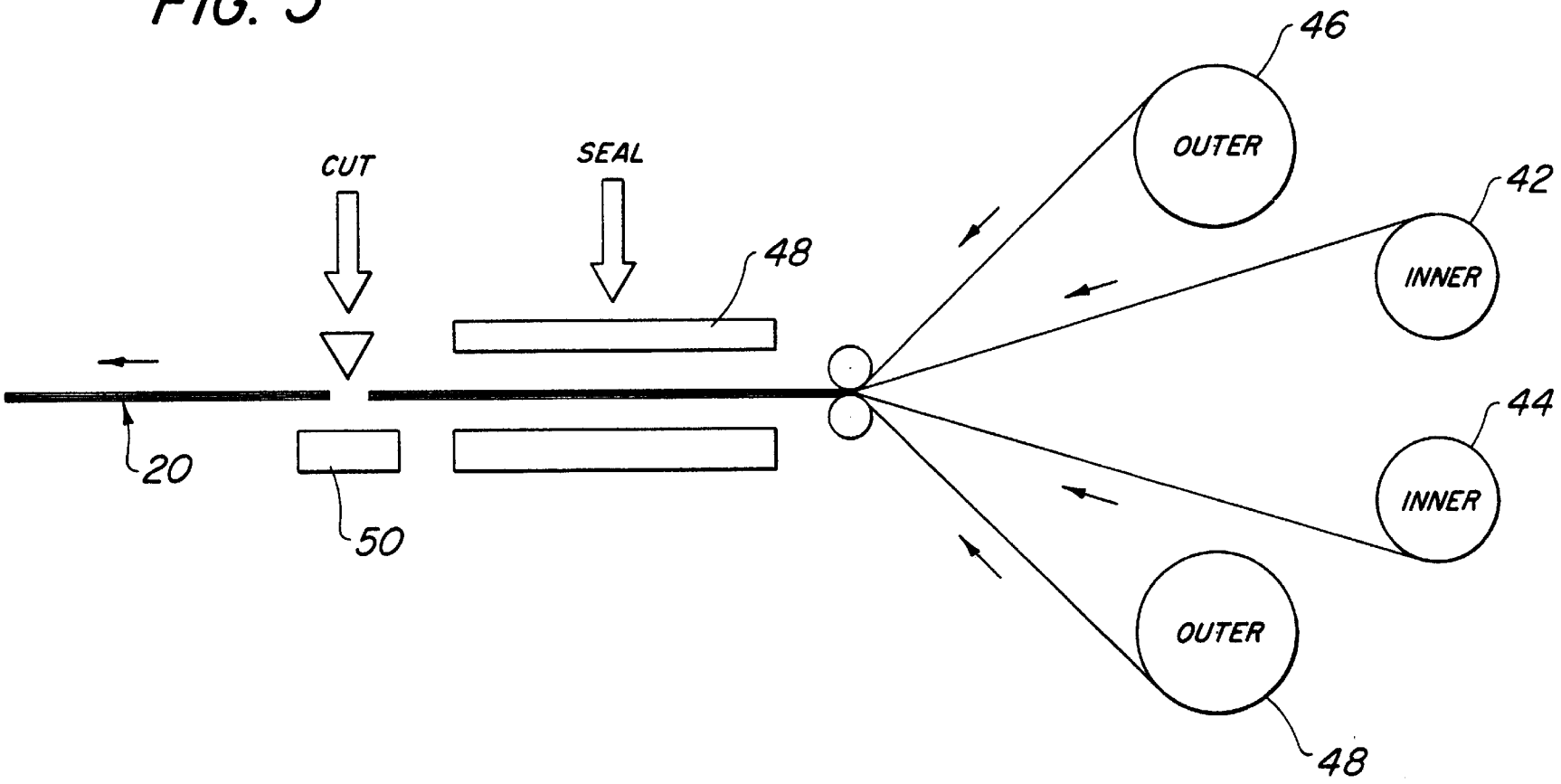
FIG. 5 is a schematic illustration of the manner in which the package of FIG. 1 is manufactured.

Referring now to the various figures of the drawing wherein like reference characters refer to like parts, there is shown at 20 in FIG. 1 a flexible package in the form of a bag or pouch constructed in accordance with this invention for holding a flowable material, e.g., powdered milk. The package is convertible, i.e., includes an inner sealed bag and an outer removable cover, as will be described later, so that it can be transported and handled and its outer covering removed then brought into a clean room for processing without fear that the package holding the material had become soiled or contaminated during transportation and/or handling since any such soiling/contamination would have been of the outer cover and not of the inner bag.

The package is of a generally rectangular shape (but could be of any shape desired). It is preferably constructed of four, panels or sheets of a flexible material. In the embodiment shown herein each of the panels is generally rectangular. Two of the panels, namely, panels 22 and 24 make up the front and rear panels, respectively, of an inner pouch 26 (FIG. 3). The front panel 22 includes a linear top edge portion 22A, a linear bottom edge portion 22B and a pair of opposed side edge portions 22C and 22D. The rear panel 24 includes a linear top edge portion 24A, a linear bottom edge portion 24B and a pair of opposed side edge portions 24C and 24D. The front and rear panels are permanently secured, e.g., heat sealed or welded, to each other along their respective peripheral edge portions to form a hollow interior 28 (FIG. 3) of the pouch 26 and into which the flowable material, e.g., the powdered milk, 10 is disposed to keep it in a sanitary protected condition, isolated from the ambient surroundings.

The second two panels 30 and 32 of the package 20 form a removable outer covering for the inner pouch 26. The outer panel 30 forms the cover for the front panel 22, while the outer panel 32 forms the cover for the rear panel 24. To that end the cover panels 30 and 32 are the same size and shape as the front and rear panels 22 and 24, respectively, of the inner pouch 26. In particular, the front cover panel 30 includes a linear top edge portion 30A, a linear bottom edge portion 30B and a pair of opposed side edge portions 30C and 30D. The rear cover panel 32 includes a linear top edge portion 32A, a linear bottom edge portion 32B and a pair of opposed side edge portions 32C and 32D. The front and rear cover panels are releasably, e.g., peelably, secured along their respective marginal edge portions to the underlying marginal edge portions of the front and rear panels that form the inner pouch 26. Thus, the outer or cover panels can be peeled from the panels forming the inner pouch, leaving the inner pouch intact holding the product 10 therein.

As best seen in FIGS. 1 and 2, the releasable securement of the front and rear cover panels to the inner pouch is all along the periphery of inner pouch 26 except for one corner 36. In that corner 34, the front cover panel 30 is peelably secured along a diagonal seal line 36 to the top panel 22 of the inner pouch. In a similar manner the rear cover panel 32 is peelably secured along a diagonal seal line 38 to the rear panel 24 in the corner 34. The front and rear panels of the inner pouch are permanently sealed together along an aligned diagonal seal line 40. This arrangement leaves a small triangular portion of the front cover panel 30 unsecured to the underlying pouch 26, and a similar small triangular portion of the rear cover panel unsecured to the underlying pouch 26. These unsealed triangular areas allow hand access to the interface between the front cover panel and the inside pouch 26 to enable the user to peel away that cover panel easily. In particular, all the user has to do is to merely grasp the unsealed triangular corner of the front cover panel between his/her thumb and index finger and then pull on the front cover panel to peel it off the underlying front panel 22 of the pouch 26. The rear cover panel can be similarly peeled off of the rear panel of the pouch 26. In FIG. 4, the package 20 is shown in the process of having its front and rear cover panels peeled off of the sealed inner pouch 26. Thus, if either or both of the cover panels had become soiled or otherwise contaminated they can be easily removed, leaving a sanitary sealed pouch 26.

As should be appreciated by those skilled in the art there are several methods of forming the peel seal interface between the outer cover panels and the inner pouch panels. In this regard, the formation of peel seals is well known in the packaging industry. For example, blends of various polyolefins such as polyethylene and polybutylene along with other additives are used to form peel seals in cereal box liners. Any of these methods can be used to form the peel seal interface between the outer cover panels and inner pouch panels.

The package 20 may be formed of a variety of paper, plastic and/or foil materials as required by the product to be packaged as long as they can be thermally welded together to form a permanently sealed inner pouch and peelably sealed cover panels using any conventional sealing techniques well known to the flexible packaging industry. For example, in one particular exemplary embodiment of this invention the outer or cover panels 30 and 32 are formed from laminated barrier material, e.g., a 48 gauge polyester, adhesive, a 28 gauge aluminum foil, an adhesive, a 48 gauge polyester, an adhesive and 3.0 mil peel seal coextrusion. The peel seal coextrusion is formed of two layers. The layer next to the adhesive layer is a blend of 80% LLDPE and 20% LDPE, and is 2.7 mils thick. The second layer is the peel seal layer. It is composed of a blend of 75% LDPE, 5% Polybutylene and 10% EVA copolymer. This blend is designed to form a peelable seal when sealed to polyethylene.

In the aforementioned exemplary embodiment the inner pouch panels 22 and 24 are each formed from a 4.0 mil thick film of a blend of 80% LLDPE and 20% LDPE.

As should be appreciated by those skilled in the art, with the product 10 packaged in the inner pouch 26, and covered with the cover panels, it may be transported and handled at will, irrespective of whether or not the cover panels become soiled or otherwise contaminated, since they are arranged to be readily removed from the inner pouch before the inner pouch is brought into a clean room environment where the contents 10 of the pouch are removed for processing. To that end when it is desired to bring the pouch 26 into the clean environment all that is required is to peel the cover panels 30 and 32 from the inner pouch 26, leaving the pouch sealed (and thus protective of the product 10 stored therein). The cover panels can then be discarded. When processing of the material 10 is to be accomplished, the pouch 26 may be opened by any suitable means, e.g., the package may be cut or otherwise penetrated to enable the contents 10 to be removed therefrom. If desired, the inner pouch 26 may include an easy-to-open, e.g., peelable, mouth to provide ready access into its interior where the product 10 is located. To that end, the portion of the pouch along the top peripheral edge portions 22A and 24A of the front and rear panels 22 and 24, respectively, may be in the form of a peelable seal (and/or the diagonal seal may be peelable) in lieu of the permanent seal described heretofore. The peelable seal for the mouth of the inner pouch 26 may be formed by any suitable conventional means, such as the use of a peel seal coextrusion, similar to that used to form the peelable seals for the cover panels.

As best seen in FIG. 5, the materials for forming the various panels of the package 20 may be provided as sheeting on rolls. In such an arrangement, the materials forming the four panels 22, 24, 30 and 32 are unwound from rolls 42, 44, 46 and 48, respectively, of the heretofore identified flexible materials and stacked one on another in the following order: the material forming front cover panel 30 with the polyester side facing up, the material forming the inner pouch front panel 22, the material forming the inner pouch rear panel 24, and the material forming the rear cover panel 32 with the polyester side facing down. A hot sealing plate 48 with a sealing die engraved to the desired size is then used to seal the four layers 30, 22, 24, 32 to form the inner pouch 26 and to peelably bond the cover panels thereon in a single step. Excess material can then be trimmed or cut by suitable machinery 50 from the perimeter of the package 20.

As should be appreciated from the foregoing the package of this invention is particularly suited to hold a variety of granular or powdered products during shipping and handling prior to use. From the time the product is packaged until it is ready for use, the package may become soiled or otherwise contaminated on its surface. The package is designed so that the outside layers can be stripped away leaving the product packaged in a clean inner pouch. This type of package is particularly useful in applications where the product is to be used in a clean room environment. For example, the package may be used to hold powdered milk during storage and transport. Just prior to use, the outer panels can be stripped away from the inner panels. The clean, untouched inner panels containing the product can now be moved into a clean environment for use e.g., further processing.

Without further elaboration the foregoing will so fully illustrate my invention that others may, by applying current or future knowledge, adopt the same for use under various conditions of service.

I claim:

1. A package having an interior for holding a product therein, said package having a front panel and a rear panel, a front cover sheet and a rear cover sheet, each of said front and rear panels being formed of a flexible sheet material and a panel peripheral edge, said panel peripheral edges of said front and rear panels being secured to each other at a panel seal line to form a hollow interior for the package for holding the product therein, said panel peripheral edges each including a top edge, a bottom edge, a pair of opposed side edges, and a diagonal edge extending between said top edge and one side edge of said pair of said opposed side edges, with respective edges of said panels being secured together along said panel seal line, said package including a mouth located between said front and rear panels, said mouth being arranged to be opened after said cover sheets are removed from said package to provide access to the interior of said package, said front cover sheet being formed of a flexible material and being of sufficient extent to cover the entire area of said front panel and having a front cover sheet peripheral edge that adjoins said entire peripheral edge of said front panel and having a rear cover sheet peripheral edge that adjoins said entire peripheral edge of said rear panel, said front cover sheet being releasably secured to said front panel to effectively isolate said front panel from the ambient surroundings, said rear cover sheet being formed of a flexible material and being of sufficient extent to cover the entire area of said rear panel, said rear cover sheet being releasably secured to said rear panel to effectively isolate said rear panel from the ambient surroundings, each of said cover sheets being separately removable from said panels, leaving said panels secured together with said product sealed within said hollow interior, each of said front cover sheet and said rear cover sheet having a portion of said flexible material extending outside the panel seal line, adjacent said diagonal edge to form a grasping area to assist a user in separating said cover sheets from said panels.

2. The package of claim 1 wherein said top edges are releasably secured to each other to form said mouth.

3. The package of claim 1, wherein said cover sheets are peelably secured to said panels.

4. The package of claim 1 wherein said mouth includes a peelable seal.

5. The package of claim 1 wherein said flexible sheet material forming said panels is suitable for being hermetically sealed.

* * * * *

UNITED STATES PATENT AND TRADEMARK OFFICE

CERTIFICATE OF CORRECTION

PATENT NO. : 6,280,085 B1
DATED : August 28, 2001
INVENTOR(S) : Jeffrey Scott Beer It is certified that error appears in the above-identified patent and that said Letters Patent is hereby corrected as shown below:

Column 5,
Line 26, replace the reference number “48” with -- 49 --.

Drawings,
Fig. 5, replace the reference number “48,” shown indicating a hot sealing plate which is located underneath the arrow labeled “SEAL”, with -- 49 --.

Signed and Sealed this

Eleventh Day of June, 2002

*Attest:*

*Attesting Officer*

JAMES E. ROGAN
*Director of the United States Patent and Trademark Office*